US005282636A

United States Patent [19]

Wyman et al.

[11] Patent Number: 5,282,636

[45] Date of Patent: Feb. 1, 1994

[54] NOVELTY GAME

[75] Inventors: Melvin J. Wyman, Venice, Calif.; David A. Hilderbrand, Grants Pass, Oreg.

[73] Assignees: Sheldon Katz; Aqua Skill Incorporated, both of Canoga Park, Calif.

[21] Appl. No.: 931,063

[22] Filed: Aug. 17, 1992

[51] Int. Cl.[5] ..... A63F 9/00

[52] U.S. Cl. ..... 273/457

[58] Field of Search ..... 273/457

[56] References Cited

U.S. PATENT DOCUMENTS

| | | | |
|---|---|---|---|
| 2,135,292 | 11/1938 | Pocell | 273/457 X |
| 2,191,150 | 2/1940 | Abell | 273/457 X |
| 2,482,893 | 9/1949 | Bawden | 273/457 X |
| 2,746,757 | 5/1956 | Frost | 273/457 X |
| 4,177,986 | 12/1979 | Campbell | 273/457 X |
| 4,418,912 | 12/1983 | Tottey | 273/457 X |

*Primary Examiner*—William H. Grieb

*Attorney, Agent, or Firm*—Graham & James

[57] ABSTRACT

A game device wherein the player drops a coin through a clear liquid contained in a vessel and attempts to capture the coin on the surface of one of a plurality of pads disposed within the liquid. The vessel is preferably formed from a clear material such as plexiglas, and disposed at least partially therein is an actuating means for manipulating a plurality of upwardly facing pads such that the actuating means can be used to manipulate the relative positions of the pads to capture the coin dropped into the vessel, as the coin descends through the liquid.

10 Claims, 2 Drawing Sheets

NOVELTY GAME

BACKGROUND OF THE INVENTION

The present invention is directed to a game or novelty device into which a player inserts a coin and subsequently manipulates a portion of the device in an attempt to achieve a desired goal or result. More specifically, the device defines an enlarged vessel which is filled with a fluid, such as water or mineral oil, into which a coin is dropped and a player then attempts to catch the coin on the surface of one or more pads. The position of the pads can be manipulated by the player.

In various types of commercial establishments, it is common to find a donation box soliciting charitable contributions for any number of worthy causes. Generally, these comprise a simple receptacle having a coin entry slot, and a representation of the particular charity involved. A person wishing to make a contribution simply deposits a coin into the receptacle.

It has been found that in order to increase the amount of contributions, it is desirable to convert the donation box into a game of chance or skill, offering the donor the opportunity to win some type of prize. A number of different devices incorporate this concept. Alternatively, these types of devices can also be used as a gaming device wherein the player attempts to perform some task in order to win a prize in excess of the value of the coin which he uses to play the game.

While there are various types of devices incorporating these concepts, it is beneficial for charitable causes and the gaming industry to develop new and different types of games, to continually interest the donor or player, and to challenge them to donate or play the game more often. Accordingly, there is a continual need for new types of devices which incorporate various games of skill.

SUMMARY OF THE INVENTION

The present invention is directed to a game of skill in which the player drops a coin into a vessel filled with a liquid, such as water or clear mineral oil, and attempts to capture the coin on the surface of one of a plurality of pads disposed within the liquid. The player can manipulate the relative position of the pads in order to try to capture the coin. Thus, the present invention includes a vessel which is preferably formed from a clear material such as plexiglas, and disposed at least partially therein an actuating means for manipulating a plurality of upwardly facing pads such that the actuating means can be used to manipulate the relative positions of the pads to capture the coin dropped into the vessel, as the coin descends through the liquid.

In the preferred embodiment, the plurality of upwardly facing pads are attached to a centrally disposed cylinder projecting upward from the vessel which may be rotated by the player. As the coin descends through the liquid the player rotates the cylinder, thereby changing the position of the plurality of pads, in an attempt to capture the coin on the surface of one of the pads. The cylinder can also be connected to a catch tray located at the bottom of the vessel such that the owner of the device can simply lift the rotatable cylinder and catch tray from the liquid to gather the coins captured in the catch tray.

By this simple construction, a novelty device or game of skill is configured in a visually appealing and personally challenging manner in order to increase the generated revenue. If a player successfully captures the coin on the surface of one of the plurality of pads, then a specific prize will be given corresponding to the pad onto which the coin settles.

DETAILED DESCRIPTION OF THE PREFERRED EMBODIMENT

Figure 1:
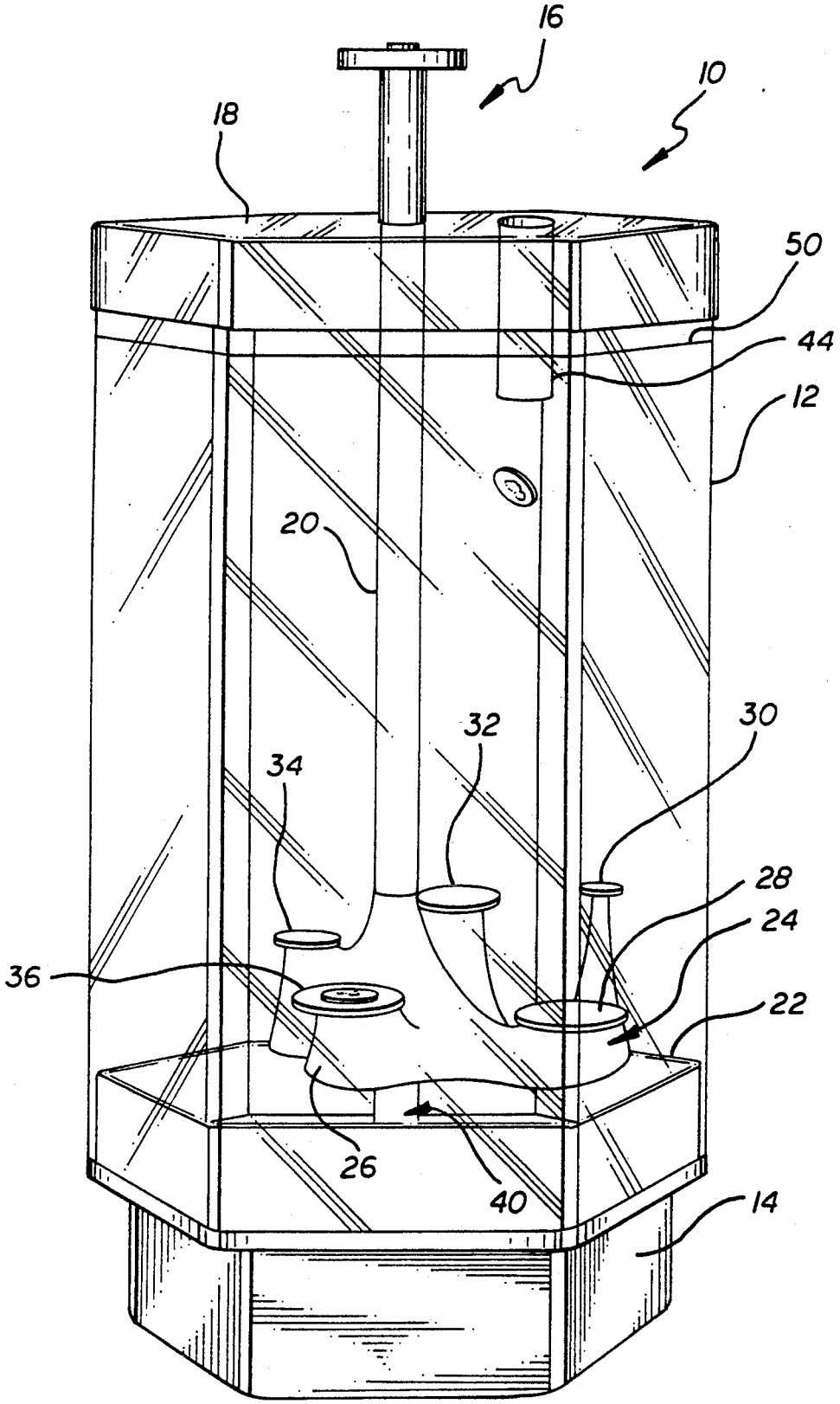
FIG. 1 depicts a perspective view of the novelty game device according to the present invention.

FIG. 1 depicts a perspective view of the game device 10 according to the present invention. The game device 10 includes a vessel 12 mounted on a base 14 and an inserted assembly 16. The inserted assembly 16 includes a cover 18 interconnected via an actuating means such as a cylindrical element 20 to a catch tray 22, which is submerged to the bottom of the vessel 12. Attached to the cylindrical element 20 is a capture means 24 which includes a molded support element 26 interconnected to the cylindrical element 20. The support element 26 provides points of attachment for a plurality of pads 28, 30, 32, 34, and 36. Each of the pads 28–36 is disposed in an upwardly facing manner on the molded support element 26 such that a coin dropping from the top of the vessel may fall upon the surface of one of the pads and be retained thereupon. It should also be noted that the pads 28–36 may be sized differently, and may be removable from the element 26.

Attached to the cover 18 of the inserted assembly 16 is a means for allowing insertion of a coin into the vessel 12, and for initially constraining the decent of the coin. The means for allowing insertion may be configured as a drop tube 44, which provides the insert location for a coin 46 which is deposited into the vessel 12 through the drop tube 44.

The vessel 12 is filled with an optically transparent or clear liquid 50, such as water or mineral oil, to a level near the top of the vessel 12. Preferably, the lower portion of the drop tube 44 extends into the liquid 50. By this configuration, a coin dropped through the drop tube 44 traverses the drop tube 44 first through an air medium and then subsequently a fluid medium to establish its initial downward trajectory.

The drop tube 44 is preferably configured to be slightly larger in its internal diameter than a quarter. In this configuration, a quarter inserted into the drop tube 44 will traverse the liquid filled portion of the drop tube 44 very slowly, due to the restricted flow around the edges of the coin. It should also be appreciated that alternative arrangements contemplate having the drop tube 44 sized to be slightly larger than other desired coin denominations, such as nickles and dimes, in order to provide the slowed decent feature.

As the coin proceeds to fall through the liquid, after traversing the drop tube 44, the natural resistance to its passage will cause the coin to rotate and slip in an arbitrary manner changing the angle and fall rate of the coin. In addition, currents circulating within the liquid 50, caused for example by rotation of the cylindrical element 20 and capture means 24 attached thereto, will also effect the decent of the coin through the liquid 50.

In operation, the player drops the coin through the drop tube 44 into the liquid, and then manipulates the cylindrical element 20 via a handle or lever attached to the top of the cylindrical element 20 to cause rotation of the plurality of pads 28–36 in an attempt to align one of the pads with the trajectory of the coin as it descends through the liquid 50. If the player succeeds in capturing the coin on the surface of one of the capture pads 28–36, a prize will be awarded based upon the size and position of the pad onto which the coin lands. Thus, for a pad having a smaller surface area, a more valuable prize is awarded than for a pad having a larger surface area.

Figure 2:
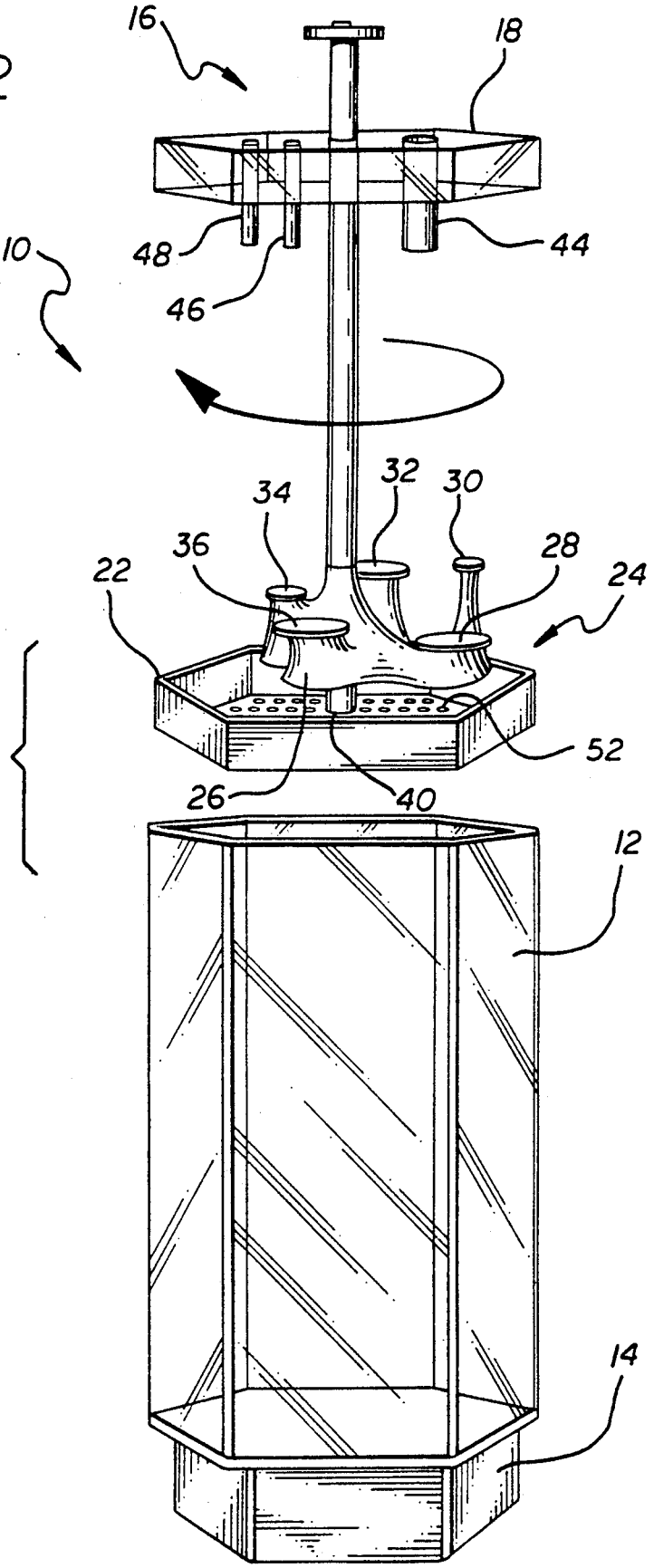
FIG. 2 depicts an exploded perspective view of the removable portion and the vessel of the device of FIG. 1.

FIG. 2 depicts the inserted assembly 16 removed from the vessel 12. As may better be appreciated from the view in FIG. 2, the catch tray 22 of the inserted assembly 16 includes a plurality of holes 52 in the base portion thereof to allow drainage of the liquid from the catch tray 22 when the entire inserted assembly 16 is raised from the vessel 12 in order to allow the operator to gather the coins in the catch tray 22. It should also be noted that the cylindrical element 20, while being securely affixed to the catch tray 22, is preferably rotatable with respect thereto so that the operator does not have to rotate the entire catch tray in order to allow rotation of the cylindrical element 20 and capture means 24 and molded support element 26 attached thereto. Additionally, as illustrated in FIG. 2 the means for allowing insertion may include more than one drop tube 44, 46, 48, each of which is sized for a particular coin denomination.

The lower half of FIG. 2 illustrates the vessel 12 including the fluid 50 sitting atop the base 14, with the inserted assembly 16 removed. While illustrated in a hexagonal shape, the shape of the vessel 12 can be selected from any number of different shapes, including a cylinder or elliptical cylinder, or other desirable geometric shape such as a triangle, square, rectangle, hexagon, octagon, decagon, etc. Also, preferably, the upright portion of the vessel 12 including the walls is preferably formed from plexiglass, or alternatively from glass, to allow the player to view the coin as it traverses down through the fluid 50.

In addition, each of the elements of the inserted assembly 16 is preferably formed from a plexiglass material. Various colors may be incorporated into portions of the inserted assembly 16 in order to enhance the visual appearance for the novelty game device 10. It is specifically contemplated that the catch pads 28, 30, 32, 34, and 36 may be formed of a colored plexiglass material, and the pads can be individually removable from the molded support element 26. The molded support element 26 is also preferably formed from either a clear or colored plexiglass material.

Various alternative features can be added to make the game device 10 more or less difficult. Thus, for example, a portion of the vessel may be made opaque or mirrored. Also, internal lighting can be provided in a manner such that the heat from the light source will cause thermal turbulence in the liquid 50, thereby further altering the decent of the coin. As another feature, the vessel can be partially filled with two or more different fluids, such as water and oil, which separate due to their specific gravity and do not mix together. Any of these added features, either alone or in combination, will substantially increase the difficulty of capturing a coin on one of the pads, and further challenge the player. In addition, these different features may easily be added on after various patrons become more skilled in manipulating the basic game device 10.

The foregoing description provides an exemplary configuration for the device of the present invention. However, it is to be appreciated that those skilled in the art will be able to devise alternative configurations. Accordingly, the invention is constrained only by the proper literal and equivalent scope of the appended claims.

We claim:

1. A coin gaming device comprising:

vessel means defined by a base and upwardly projecting walls for containing an optically transparent fluid;

cover means for covering the top of said vessel means and for defining an opening for insertion of a coin into said vessel;

capture means including a plurality of upwardly facing pads for intercepting the downward passage of a coin inserted into said vessel as the coin transverse downward through said fluid;

means for allowing manipulation of said capture means; and tray means having a perforated base and being rotatively affixed to said means for allowing manipulation and removable with said cover means, for catching coins at the bottom of said vessel, and for allowing for easy removal of the coins.

2. The gaming device of claim 1, wherein said capture means further comprises:

a support element affixed to said means for allowing manipulation, said support element providing a plurality of support locations for affixation of said plurality of pads.

3. The gaming device of claim 1, wherein said means for allowing manipulation comprises:

a manipulation element extending through and rotatable with respect to said cover means, said manipulation element including a portion outside of said vessel means adapted for manual operation by a player of the gaming device, and a portion extending inside said vessel connected to said capture means.

4. The gaming device of claim 1, wherein said tray means comprises:

a plexiglass perforated base and side walls attached to said base.

5. The gaming device of claim 1, further comprising:

means for controlling the initial decent of said coin upon insertion into the gaming device, said means for controlling including at least one tube affixed to and extending through said cover means, said tube having a length sufficient to extend into the optically transparent fluid and an internal diameter slightly larger than a coin.

6. The gaming device of claim 5, wherein said means for controlling comprises:

a plurality of cylindrical tubes affixed to and extending through said cover means, each of said tubes having an internal diameter sized to be slightly larger than a particular denomination of a coin; and means for restricting the denomination of coin inserted into a particular one of said plurality of tubes.

7. A coin game device comprising:

a vessel;

a cover for said vessel;

a fluid contained in said vessel;

means for allowing insertion of a coin into said vessel through said cover;

a player operated capture means for capturing said coin as it descends through said fluid, said capture means including a shaft extending axially through said cover and into said fluid; and a bottom tray having a perforated base and being rotatively affixed to said shaft and removable with said player operated capture means, said bottom tray operative to collect coins at the bottom of said vessel, and allow for removal of the coins.

8. The coin game device of claim 7, wherein said player operated capture means further comprises:

means for defining a plurality of openings for insertion of a coin into said vessel;

capture means for intercepting the downward passage of a coin inserted into said vessel as the coin traverses downward through said fluid; and means for allowing manipulation of said capture means.

9. The coin game device of claim 8, wherein said means for allowing insertion comprises:

means for controlling the initial decent of said coin upon insertion into the gaming device, said means for controlling affixed to and extending through said cover means.

10. The coin game device of claim 7, wherein said vessel and said capture means are formed at least in part from an optically transparent rigid material.

* * * * *